US005266962A

United States Patent [19]

Möbius et al.

[11] Patent Number: 5,266,962

[45] Date of Patent: Nov. 30, 1993

[54] METHOD OF CONVERTING TRANSVERSE ELECTRICAL MODES AND A HELICALLY OUTLINED APERTURE ANTENNA FOR IMPLEMENTING THE METHOD

[75] Inventors: Arnold Möbius, Eggenstein; Manfred Thumm, Sindelfingen, both of Fed. Rep. of Germany

[73] Assignee: Kernforschungszentrum Karlsruhe GmbH, Karlsruhe, Fed. Rep. of Germany

[21] Appl. No.: 803,079

[22] Filed: Dec. 6, 1991

[30] Foreign Application Priority Data

Dec. 6, 1990 [DE] Fed. Rep. of Germany ..... 4038837

[51] Int. Cl.[5] ..... H01Q 13/00

[52] U.S. Cl. ..... 343/781 R; 343/772; 333/21 R

[58] Field of Search ..... 343/781 R, 756, 772, 343/786, 895; 333/21 A

[56] References Cited

U.S. PATENT DOCUMENTS

| | | | |
|---|---|---|---|
| 3,413,642 | 11/1968 | Cook | 343/781 R |
| 3,653,055 | 3/1972 | Wu et al. | 343/781 R |
| 4,231,042 | 10/1980 | Turrin | 343/786 |
| 4,704,611 | 11/1987 | Edwards et al. | 343/786 |
| 4,731,616 | 3/1988 | Fulton et al. | 343/786 |
| 4,783,665 | 11/1988 | Lier et al. | 343/786 |
| 5,010,348 | 4/1991 | Rene et al. | 333/21 A |

FOREIGN PATENT DOCUMENTS

| | | | |
|---|---|---|---|
| 3247592 | 6/1984 | Fed. Rep. of Germany | 333/21 A |
| 2170054 | 7/1986 | United Kingdom | 333/21 A |

OTHER PUBLICATIONS

S. N. Vlasov et al, "Transformation of a Whispering Gallery Mode, Propagating in a Circular Waveguide, into a Beam of Waves", *Radio Engineering, Electron Physics*, vol. 21, 1975, pp. 14–17.

M. Thumm, "Computer-Aided Analysis and Design of Corrugated $TE_{11}$ to $HE_{11}$ Mode Converters in Highly Overmoded Waveguides", *International Journal of Infrared and Millimeter Waves*, vol. 6, 1985, pp. 577–597.

Danley et al, "Whispering-Gallery-Mode Gyrotron Operation with a Quasi-Optical Antenna", *IEEE Transactions on Plasma Science*, vol. 13, No. 6, Dec., 1985, pp. 383–388.

Wada et al, "Calculation of radiation from a quasi-optical reflector antenna for whispering galley mode", *International Jounral of Electronics*, vol. 65, No. 3, 1988, pp. 725–732.

Vernon et al, "Design of TE11- to HE11 mode converter in a highly over-moded corrugated circular waveguide to be used as a reflector feed for plasma heating", Antennas and Propagation, vol. 1, Jun., 1985, pp. 327–330.

*Primary Examiner*—Donald T. Hajec
*Assistant Examiner*—Tan Ho
*Attorney, Agent, or Firm*—Spencer, Frank & Schneider

[57] ABSTRACT

A mode converter for converting transverse electric modes into hybrid modes of type $EH_{mn}$ and including a circular waveguide provided with corrugations extending in a circumferential (azimuth) direction that become deeper toward its end and are continued in a subsequent helically outlined aperture antenna with constant depth. The emitted radiation is circularly polarized and, by the use of suitable reflectors for the emitted radiation, may be cause to be linearly polarized. The emitted radiation no longer has any sidelobes in the far field and its characteristic has a Gaussian profile over the azimuth angle.

6 Claims, 3 Drawing Sheets

METHOD OF CONVERTING TRANSVERSE ELECTRICAL MODES AND A HELICALLY OUTLINED APERTURE ANTENNA FOR IMPLEMENTING THE METHOD

REFERENCE TO RELATED APLICATIONS

This application claims the priority of Federal Republic of Germany application Serial No. P 40 38 837.9, filed Dec. 6, 1990, which is incorporated herein by reference.

BACKGROUND OF THE INVENTION

The present invention relates to a method of converting transverse electric modes and to a helically cut aperture antenna for implementing the method. More particularly, the present invention relates to a method of converting transverse electrical modes which are then radiated by the aperture antenna into the space in front of it.

Electron cyclotron resonance heating elements for plasma fusion experiments require a high power of several megawatts at a frequency of about 140 GHz; this power is generated by gyrotrons. The typical gyrotron operating modes are transverse electric modes $TE_{mn}$ having a high first (azimuthal) index (m) and a relatively low (radial) index (n). Such modes are not suitable for heating plasma, but rather must be converted into a linearly polarized, approximately Gaussian beam.

An article by M. Thumm, "Computer-Aided Analysis and Design of Corrugated $TE_{11}$ to $HE_{11}$ Mode Converters in Highly Overmoded Waveguides", *International Journal of Infrared and Millimeter Waves,* Volume 6 (1985) pages 577–597, recommends a method with which transverse electric modes can be converted into hybrid modes by a mode converter comprising a circular waveguide with circumferential or annular corrugations on its interior surface whose depth gradually decreases from one half to one quarter of the wavelength in the direction of propagation toward an aperture antenna.

So-called Vlasov converters have been used in the past for a quasi optical conversion. Such a converter is composed of a helically cut aperture antenna connected to a waveguide end, and one or a plurality of reflectors in the beam path (see: S. N. Vlasov et al, "Transformation of a Whispering Gallery Mode, Propagating in a Circular Waveguide, into a Beam of Waves", *Radio Engineering, Electron Physics,* Vol. 21, 1975, pages 14–17).

In the intended emission of rotating transverse electrical modes, undesirable sidelobes of the beam characteristic appear in the far field (Fraunhofer region). Moreover, at the high emission energy, the antenna is subjected to stresses which cannot be managed without direct cooling measures.

SUMMARY OF THE INVENTION

It is an object of the present invention to provide a method and apparatus which make available a high energy circularly or linearly polarized microwave beam that has a predetermined desired beam characteristic, particularly a Gaussian profile with no side lobes in the far field.

The above object is achieved according to one aspect of the invention by a method of converting transverse electric modes into hybrid modes of type $EH_{mn}$, comprising propagating rotating transverse electrical modes in a circular waveguide having an aperture antenna at one end thereof, converting the propagating rotating transverse electrical modes into rotating hybrid modes of type $EH_{mn}$ under the balanced hybrid condition $\Lambda=-1$ or of type $HE_{mn}$ under the balanced hybrid condition $\Lambda=+1$, and radiating the hybrid modes via the aperture antenna to create a circularly polarized beam having a Gaussian profile in the far field of the antenna. Preferably, the method further comprises converting the radiated circularly polarized beam into a linearly polarized beam by reflection of the circularly polarized beam at at least one suitably corrugated reflector.

The above object is achieved according to a further aspect of the invention by an aperture antenna for implementing the above method which comprises: a helically outlined aperture antenna formed at an end of a circular waveguide and including a linear outline portion extending longitudinally to the end of the waveguide and a helical outline, formed by an end surface of the waveguide connecting the ends of the linear portion, and with the longitudinal length of the linear outline portion of the aperture antenna being fixed by the balanced hybrid condition $\Lambda=\pm 1$, the vacuum wavelength of the propagating modes, the mode, and the waveguide radius; and circumferentially extending corrugations formed on the interior surface of the portion of the waveguide forming the aperture antenna, with the depth of these corrugations being one quarter of the vacuum wavelength, the width of these corrugations being different from the depth of the corrugations, and the periodicity length of these corrugations being approximately equal to or less than one third of the vacuum wavelength.

The method according to the invention and the aperture antenna for implementing the method will be described below in greater detail with reference to the drawing figures.

DETAILED DESCRIPTION OF THE PREFERRED EMBODIMENT

Figure 1:
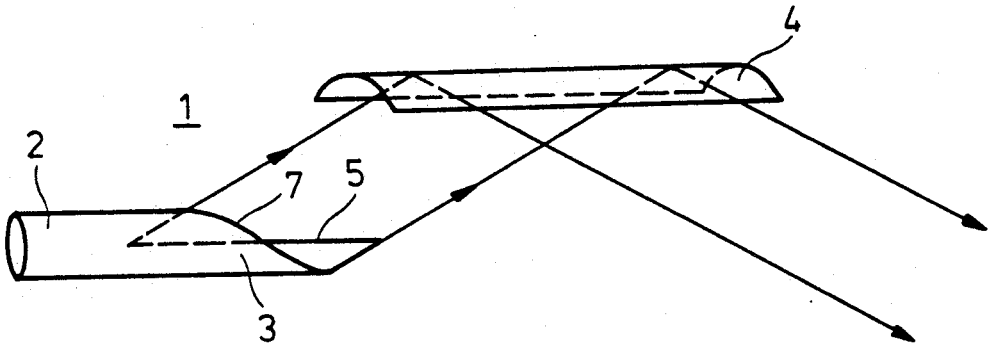
Fig. 1 PRIOR ART
FIG. 1 schematically shows a conventional quasi optical mode converter having a helically apertured antenna on which the present invention is based.

FIG. 1 shows a conventional quasi optical mode converter 1, in technical terminology also called a Vlasov converter. It is composed of a circular waveguide end 2, an aperture antenna 3 and, for example, a reflector 4. The antenna 3 is the continuation of the coaxially arranged waveguide end 2. At its end, the antenna 3 is outlined by a longitudinally extending linear portion or edge 5 of predetermined length on waveguide surface 6 and by a helical line or end surface 7 on waveguide surface 6, with the latter connecting, i.e., extending between, the beginning and the end of the linear length 5. The circularly polarized electromagnetic wave propagating in the waveguide end 2 is radiated through the antenna aperture in a preferred direction into the space in front of the antenna 3. With the aid of the reflector or reflectors 4, the emitted wave can be linearly polarized in a known manner.

Figure 2:
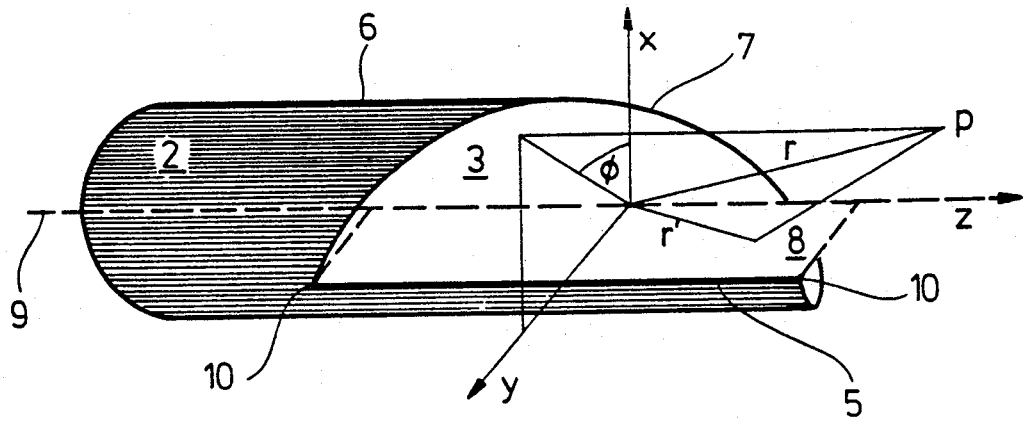
FIG. 2 shows the antenna, aperture and coordinate system of a mode converter according to the invention.

FIG. 2 shows antenna 3 and its waveguide end 2 to an enlarged scale. The length 5 of antenna 3 is calculated from the assumption that the uninterfered with field distribution of the waveguide 2 is present on the rectangular aperture 8, defined by the waveguide longitudinal axis 9 and the linear section 5 of antenna 3, and that the energy transported through the aperture 8 is equal to the energy flowing through the waveguide 2. The antenna length L, i.e., the length of linear portion 5, results as follows:

$$L = 2\pi R_w \frac{k_{\parallel}}{k_{\perp}} \frac{m}{X_{mn}} \left[ 1 + \frac{1}{m\beta} \frac{(1 \pm \Lambda)^2 \beta I_2 + 2\Lambda(mI_3 \quad \beta I_2)}{(1 \pm \Lambda)^2 m I_1 + 2\Lambda(\beta I_3 \quad m I_1)} \right]$$

$$\text{where } \beta = \frac{k_{\parallel}}{k},$$

$R_w$ is the waveguide radius, $k^2 = k^2_1 + k^2_{11}$ is the relation between wave propagation vectors with the indices indicating the direction parallel (11) and perpendicular (1) to the wave guide axis, m and n are indicate the azimuthal and radial index of the mode with the eigenvalue $X_{mn}$.

Since hybrid modes can be expressed as a combination of TE- and TM-modes, the hybrid factor determines the TE-mode content which varies from pure TE mode ($\Lambda = +\infty$) to pure TM-mode ($\Lambda = 0$).

The integrals $I_1$, $I_2$ and $I_3$ have the following respective relation:

$$I_1 = \int_0^{X_{mp}} \frac{J_m^2}{x} dx = \frac{1}{2} m \left[ J_m^2(X_{mn}) + 1 - J_0^2(X_{mn}) - 2 \sum_{k=1}^{m} J_k^2(X_{mn}) \right]$$

$$I_2 = \int_0^{X_{mp}} x J'^2_m dx = \frac{m}{2} \left[ J_m^2(X_{mn}) - 1 + J_0^2(X_{mn}) + 2 \sum_{k=1}^{m} J_k^2(X_{mn}) \right] + \frac{X^2_{mn}}{2} \left[ J^2_{m+1}(X_{mn}) - \left[ \frac{(m+1)}{X_{mp}} J_{m+1}(X_{mn}) \right]^2 + J'^2_{m+1}(X_{mn}) \right]$$

$$I_3 = \int_0^{X_{mp}} J_m J'_m dx = \frac{1}{2} J_m^2(X_{mn}); \; mp = mn$$

J are Bessel-functions of indicated order.

Figure 4:
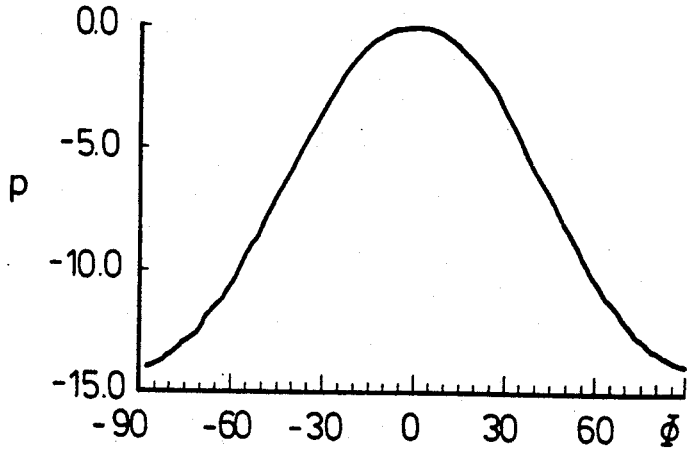
FIG. 4 is a graph showing the azimuthal dependence of the far field of the corrugated antenna according to the invention.
Figure 5:
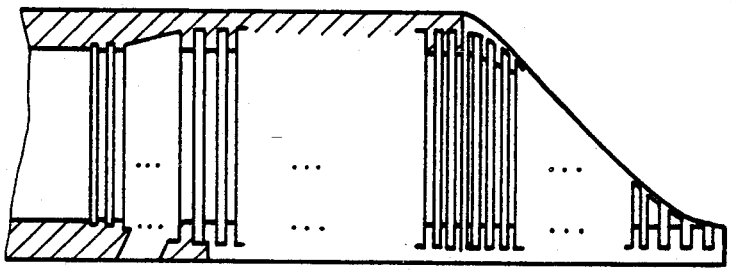
FIG. 5 shows the antenna of FIG. 3 rolled up and then cut by a plane on which the z-axis and the linear cut of the antenna are placed, and additionally indicating the corrugation depth and change in waveguide end, as well as the corrugation periodicity.

FIG. 4 shows the intented gaussion distribution over the angle $\Phi$ of the antenna radiation in the far field.

The significant parameter in the formula for determining the length L of the antenna 3, i.e., the length of linear edge or outline 5, is the hybrid parameter $\Lambda$. This parameter expresses the amount of transverse electrical modes in an electromagnetic wave to be emitted.

The helical cut 7 and the linear cut 5 of antenna 3 form acute angles at their two points of intersection 10. Developed into a plane, the helical outline 7 forms a straight line (see FIG. 3).

The interior surface of the portion of the waveguide 2 forming the aperture antenna 3, i.e., the longitudinal portion extending over the length L of linear outline portion 5, is provided with corrugations 11 (see FIGS. 3 and 3*a*) of a constant depth which extend in the circumferential (azimuth) direction and which, for the sake of clarity are not shown in FIG. 2. Preferably, the interior surface of at least a portion of waveguide 2 immediately adjacent the aperture antenna containing portion is likewise provided with corrugations 11' (see FIG. 3) which increase continuously in depth in the direction toward the antenna portion 3 to the constant depth of the corrugations 11.

Conversion from TE-modes into hybrid modes of type $EH_{mn}$ must be performed adiabatically by varying the slot depth from $O \rightarrow \lambda 4$. The length of the countersection scales with $kR_w$. Width and periodicity are chosen to be the same as in the helically cut antenna. On the other hand, conversion from TE-modes into $HE_{mn}$-modes can be achieved by gradually decreasing the depth of corrugations from $\lambda/2$ to $\lambda/4$.

Figure 3:
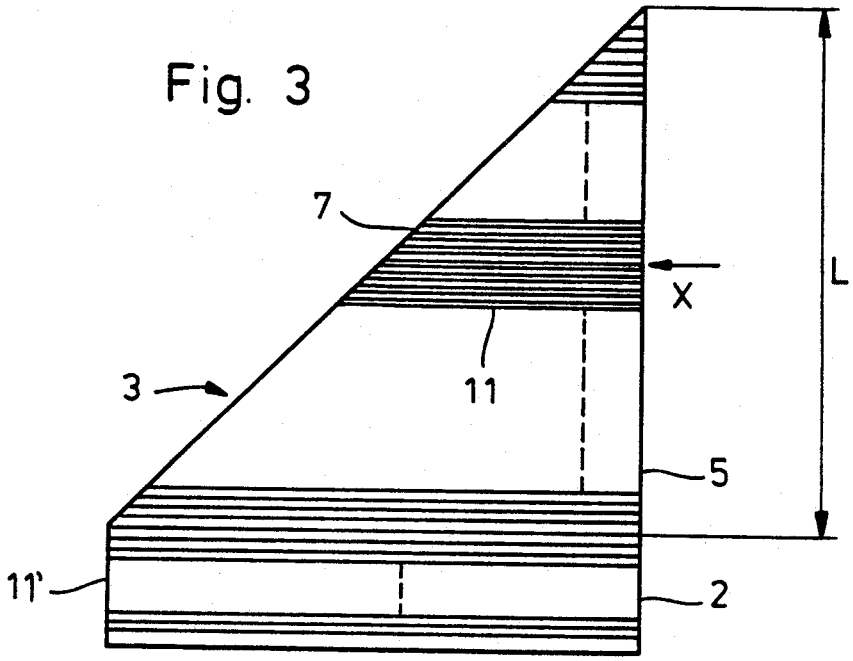
FIG. 3 is a developed schematic view of the corrugated aperture antenna of FIG. 2 according to the invention.
Figure 3A:
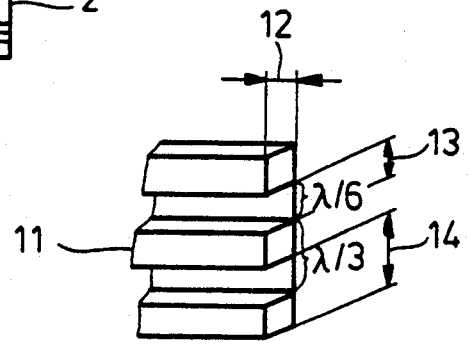
FIG. 3*a* is a partial enlarged detail view in the direction X of FIG. 3.

The development of antenna 3 and of waveguide end 2 into a plane is shown in FIG. 3. As indicated above, the corrugations 11 in antenna 3 have a constant depth. If the balanced hybrid condition is met for hybrid modes of type $EH_{mn}$ if $\Lambda = -1$ and for hybrid modes of type $HE_{mn}$ if $\Lambda = +1$. The corrugation depth 12 (FIG. 3*a*) in the antenna 3 is then precisely one quarter of the vacuum wave length, i.e. $\lambda/4$.

A corrugation width 13, i.e., the distance or spacing between two adjacent corrugations 11, of about one sixth of the vacuum wavelength ($\lambda/6$) or less has been found to be advantageous. However, the aperture antenna 3 according to the present invention noticeably loses its advantageous characteristics if the corrugation width 13 is selected to be equal to the corrugation depth, namely one quarter of the vacuum wavelength. Moreover, the corrugation length or periodicity 14, i.e., the distance between corresponding points on two adjacent corrugations, should be equal to or less than one third of the vacuum wavelength ($\lambda/3$).

Hybrid modes and their respective percentages according to the balanced hybrid condition of $\Lambda$ approximately equal to $\pm 1$ are transported with very low losses by a waveguide having a helical, corrugated aperture antenna. This is a great structural advantage for the high microwave energies encountered in fusion experiments. The expenditures for cooling the antenna can thus be reduced considerably, and under certain circumstances even avoided.

The far field of an antenna aperture constructed to meet the balanced hybrid condition $\Lambda = +1$, with a corrugation depth $= \lambda/4$ of the vacuum wavelength, has no sidelobes. This radiation has a Gaussian characteristic in the far field. This is shown in FIG. 4, namely the standardized power curve of the radiation in the far field (p) over the azimuth angle $\Phi$. After emission from the aperture antenna, the microwave beam is circularly polarized. Via a suitably ribbed or corrugated reflectors 4 (see FIG. 1), the initially circularly polarized beam radiated by the antenna is converted into a linearly polarized beam.

The method according to the invention and the aperture antenna having the corrugations according to the invention are intended for high frequency heating of fusion plasmas. First far field measurements confirm the circularly polarized beam.

One example was built for conversion from $TE_{15\text{-}2}$ into $EH_{15\text{-}2}$ at 140 GHz which is about 2.1 mm of wavelength. With a waveguide radius $R_w=13.9$ mm this resulted in an antenna length of about $L=131$ mm. Corrugation periodicity was $\lambda/3=0.7$ mm.

The invention now being fully described, it will be apparent to one of ordinary skill in the art that any changes and modifications can be made thereto without departing from the spirit or scope of the invention as set forth herein.

What is claimed is:

1. An aperture antenna for implementing a method of converting transverse electrical modes into hybrid modes of type $EH_{mn}$ or type $HE_{mn}$ by propagating rotating transverse electrical modes in a circular waveguide having an aperture at an end of the waveguide, converting the propagating rotating transverse electrical modes into rotating hybrid modes of type $EH_{mn}$ under a balanced hybrid condition of $\Lambda=-1$ for the $EH_{mn}$ and $\Lambda=+1$ for the $HE_{mn}$ modes, and radiating the hybrid modes via the aperture antenna to create a circularly polarized radiated beam having a Gaussian profile in the far field of the antenna; said antenna comprising:

a helically outlined aperture antenna formed at the end of the circular waveguide having a radius, said antenna including a linear outline portion extending longitudinally to said end of said waveguide and a helical outline portion formed by an end surface of said waveguide connecting the ends of said linear outline portion, and with the longitudinal length of said linear outline portion being fixed by said balanced hybrid condition $\Lambda=+1$, the vacuum wavelength of the propagating modes, the mode, and the waveguide radius; and circumferentially extending corrugations formed on the interior surface of the portion of said waveguide forming said aperture antenna, with the depth of said corrugations being equal to one quarter of the vacuum wavelength, the width of said corrugations being different from said depth of said corrugations, and the periodicity length of said corrugations being approximately equal to or less than one third of the vacuum wavelength.

2. An aperture antenna as defined in claim 1 wherein said width of said corrugations is at most one sixth of said vacuum wavelength.

3. An aperture antenna as defined in claim 2 wherein said width is equal to one sixth of said vacuum wavelength.

4. A mode converter for converting propagating transverse electrical modes into hybrid modes of the $EH_{mn}$ or $HE_{mn}$ type comprising:

a circular waveguide having a helically outlined aperture antenna formed at an output end thereof, with said aperture antenna being outlined by a linear longitudinally extending edge of said waveguide extending to said output end and a helical end surface of said waveguide extending between the two ends of said linear edge, with the length of said linear edge being such as to produce a balanced hybrid condition $\Lambda=-1$ for the $EH_{mn}$ and $\Lambda=+1$ for the $HE_{mn}$ modes to be radiated by the antenna; and circumferentially extending corrugations formed on the interior surface of the portion of said waveguide forming said aperture antenna, with the depth of said corrugations being constant and equal to one quarter of the vacuum wavelength of the propagating modes, the width of said corrugations being different than said depth of said corrugations, and the periodicity length of said corrugations being approximately equal to or less than one third of said vacuum wavelength.

5. A mode converter as defined in claim 4 wherein said width of said corrugations is equal to or less than one sixth of said vacuum wavelength.

6. A mode converter as defined in claim 4 wherein at least a portion of the interior surface of said waveguide adjacent said aperture antenna forming portion of said waveguide is likewise provided with circumferentially extending corrugations whose depth changes in a direction toward said antenna forming portion.

* * * * *